US006240749B1

(12) United States Patent
Stoll et al.

(10) Patent No.: US 6,240,749 B1
(45) Date of Patent: Jun. 5, 2001

(54) FLAT KNITTING MACHINE

(75) Inventors: Thomas Stoll, Reutlingen; Franz Schmid, Bodelshausen, both of (DE)

(73) Assignee: H. Stoll GmbH & Co., Reutlingen (DE)

( * ) Notice: Subject to any disclaimer, the term of this patent is extended or adjusted under 35 U.S.C. 154(b) by 0 days.

(21) Appl. No.: 09/533,019

(22) Filed: Mar. 22, 2000

(30) Foreign Application Priority Data

Mar. 27, 1999 (DE) ..... 199 14 080

(51) Int. Cl.[7] ..... D04B 7/00
(52) U.S. Cl. ..... 66/60
(58) Field of Search ..... 66/60 R, 64, 62, 66/70, 71, 78, 75.1

(56) References Cited

U.S. PATENT DOCUMENTS 579,199 * 3/1897 Wakeman ..... 66/71
2,440,496 * 4/1948 Weinstein ..... 66/71
4,774,818 * 10/1988 Ploppa et al. ..... 66/71
5,367,892 * 11/1994 Shima et al. ..... 66/71
5,475,990 * 12/1995 Schmid et al. ..... 66/78
5,992,183 * 11/1999 Shima ..... 66/64

FOREIGN PATENT DOCUMENTS 448 358 3/1968 (CH) .

* cited by examiner

*Primary Examiner*—Danny Worrell
(74) *Attorney, Agent, or Firm*—Michael J. Striker

(57) ABSTRACT

A flat knitting machine has at least one needle bed, a carriage which slides along the needle bed which has at least one cam with needle section means and stitch cams, a sinking element which cooperates with the stitch cams and is arranged movably on the stitch cams, the sinking element being controllable independently from the stitch cams and together with the stitch cams forms sinking surfaces of different size and/or form depending on its position.

9 Claims, 5 Drawing Sheets

FLAT KNITTING MACHINE

BACKGROUND OF THE INVENTION

The present invention relates to a flat knitting machine with at least one needle bed and a carriage which is slidable along the needle beds and has at least one cam with needle selection device and stitch cams:

Sinking surfaces on the needle sinkers and the stitch cams position of the cam of a knitting machine determine the form and the size of a stitch. Depending on a knitting type, different stitch sizes and forms are desired. In double-surface R-R knittings, slim stitches of the finest stitch pattern are produced. This is achieved by a small sinking surface on the stitch cams. In single-surface smooth knittings, to the contrary, round stitches of the finest stitch pattern are produced. For producing these round stitches, wide sinking surfaces are required on the stitch cams, so that as many needles as possible are held simultaneously in the deepest sinking position. In this matter the tendency is reduced that the already pulled stitches are pulled from the preceding formed stitches by the produced pulling forces of substantially knit threads and thereby substantially reduce these stitches.

During high grade knitting, in the machine the stitch cams are exchanged when a new knitting must be produced with another binding type. In most cases, however needle sinkers are used which have a central sinking surface and thereby a compromise between the optimal stitch cams sinkers for R-R knitting and a single-surface smooth knitting is formed.

The form of the knitting surface can be also determined as to whether all needles are pulled simultaneously wide during sinking, or in the same needle sinking position they can be pulled differently wide.

In the patent document CH 448 358 a stitch cams is proposed which has two sinking surfaces for producing two different stitch sizes. The same needles which have a higher needle foot are sinking on one sinking surface and the needles with the lower needle feet are sinking on the different sinking surfaces. With the stitch cams, two different stitch sizes are produced, and each size ratio of the stitches are fixed relative to one another and not changeable.

SUMMARY OF THE INVENTION

Accordingly, it is an object of the present invention to provide a flat knitting machine, in which an influence of the stitch form and/or size is possible by changing the sinking surfaces without exchanging of the stitch cams.

In keeping with these objects and with others which will become apparent hereinafter, one feature of present invention resides, briefly stated, in a flat knitting machine of the above mentioned general type, in which a sinking element with the stitch cams, which sinking element is arranged movably on the stitch cams, and which depending on the stitch cams is controllable and together with the stitch cams, depending on its position, forms sinking surfaces of different sizes and/or forms.

With this sinking element it is possible to obtain an optimal stitch pattern during both double-surface R-R knitting and during single surface smooth knitting. The stitch cams can be provided for example with a small sinking surface, which is active alone when an R-R knitting must be produced. On the sinking element also a surface can be provided which during a corresponding adjustment of the sinking element expands the sinking surface of the needle sinker so that a wide sinking surface is produced, which is optimal for producing a single-surface smooth knitting.

The adjustment to different bonding types is also possible in the inventive flat knitting machine in a simple manner. An exchange of a stitch cams is no longer required. However, a corresponding control of the sinking elements must be provided. Depending on the adjustment of the sinking element, a small or a wide sinking surface can be adjusted. Further advantages are produced when the needle sinkers and/or the sinking element has positive guiding surface for the needle feet. Thereby an uncontrolled needle movement which provides non uniformities in the stitch pattern are excluded.

The sinking element can have also a guiding surface for the needle feet, which after sinking of a stitch activates a drive of the needle in a definite distance from the sinking surface. Thereby the tensioning which acts on the knitted thread can be reduced. The different knitting bindings must be realized with different knitting yarns. When the forces in the knitting threads during the knitting process become too high, they are torn. A knitted article with such thread torn parts ("splinters") is a reject. Due to the guiding surface on the sinking element, it is however now possible, shortly after reaching the deepest sinking point, to drive the needles in a desired manner by a small distance and thereby to reduce the thread tension in the pulled-in stitch loop. During high knitting speeds a tearing of the knitting threads is prevented by these features.

The sinking element can also have a guiding surface for the needle foot, with which the pulling-in depth of predetermined needles relative to the pulling-in depth of the needle sinker-sinking surface is changeable. Thereby stitches can be formed, which have a size difference to corresponding stitches which are formed by the needle sinker-sinking surface. Therefore, a stepless adjustment of the stitch size difference by a stepless adjustment of the pulling-in depth of the predetermined needles can be performed.

For the adjustable arrangement of the sinking elements on a cam there are different possibilities. In a preferable embodiment of the present invention the sinking element is turnably arranged on the needle sinker.

It is especially advantageous when the sinking element is adjustable during the knitting process. The stitch form and size can be therefore adjusted without holding the machine during the knitting process. When the cams moreover operate in accordance with the pressing cam technique, it is also possible to definitely adjust the sinking surfaces for each individual stitch.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
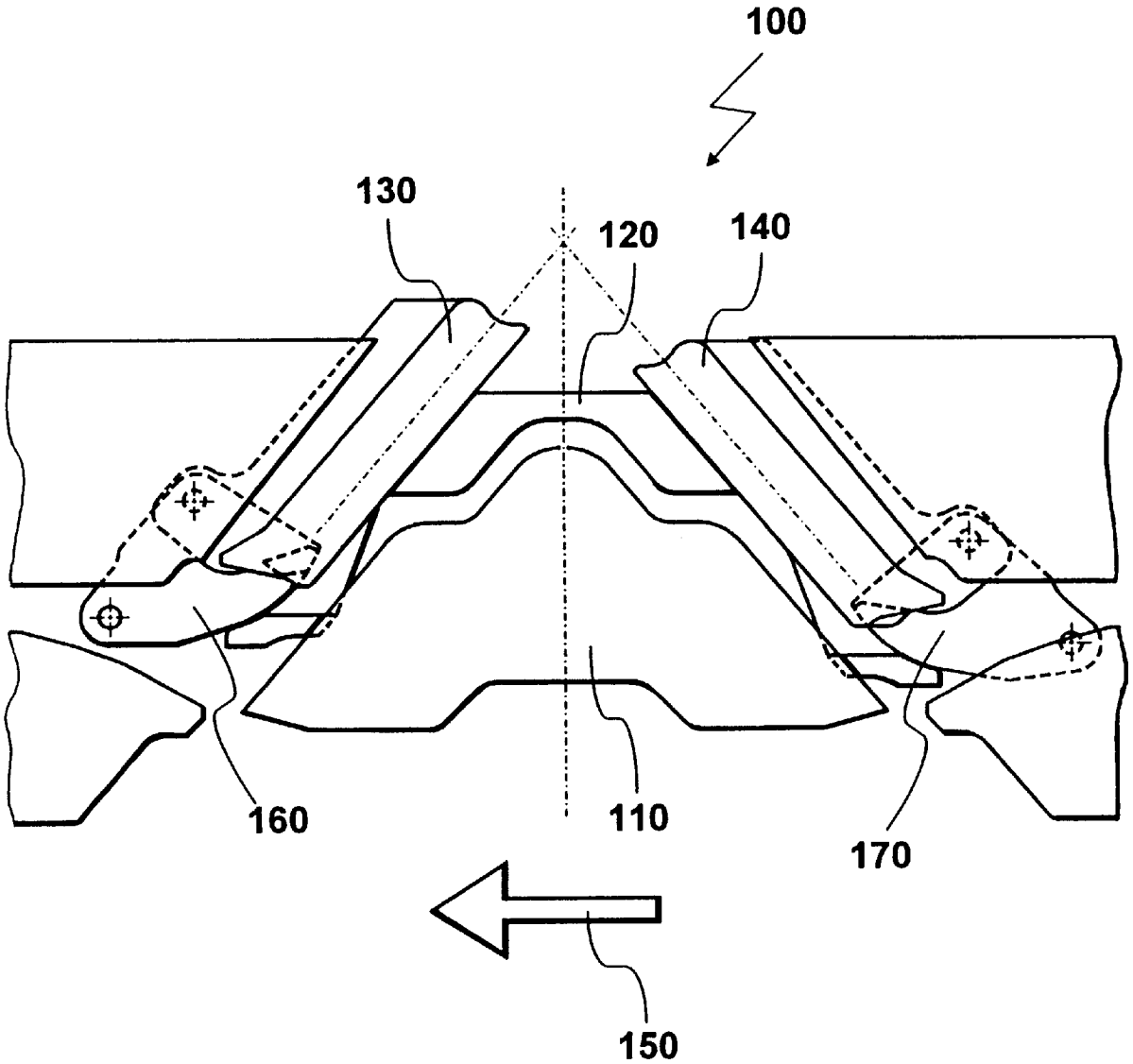
FIG. 1 is a view schematically showing a knitting cam of an inventive flat knitting machine at a side facing a needle bed.

A knitting cam 100 shown in FIG. 1 has a needle driving out part 110 which cooperates with a limiting part 120. Moreover, a forwardly running needle sinker 130 and a rearwardly running needle sinker 140 are provided on the knitting cam 100, as considered in a movement direction identified with the arrow 150. The needle sinker 130 is therefore outside operation. Moreover, the knitting cam 100 has two sinking elements 160 and 170, which cooperate with the needle sinkers 130, 140 as will be described herein below.

Figure 2:
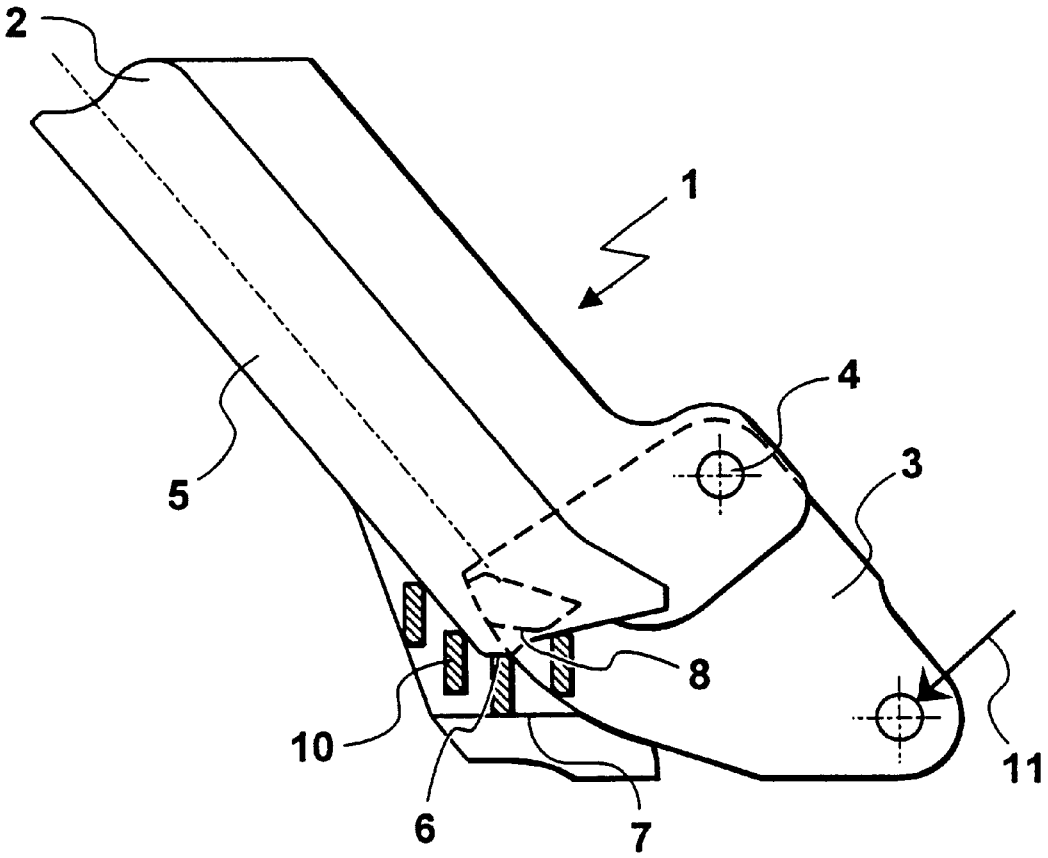
FIG. 2 is a detailed view of a stitch cam with a sinking element of the knitting cam of FIG. 1, in a first adjustment position of the sinking element.

The arrangement 1 shown in FIG. 2 corresponds to the needle sinker 140 and the sinking element 170 of FIG. 1. The needle sinker is here identified with reference numeral 2 and the sinking element is identified with reference numeral 3. The sinking element 3 is supported on the needle sinker turnably around a turning point 40. By acting in direction of the arrow 11, the sinking element 3 is turned to its inner end position. A sinking surface 8 which is available on it is thereby set outside operation. The feet 10 of the not shown needles which participate in the knitting process slide along a plane 5 of the needle sinker 2, until they reach a sinking position corresponding to the proper stitch size under a small sinking surface on the needle sinker 2. In this sinking position the needle feet 10 are positively guided by a surface 7 on the needle sinker 2, whereby a high uniformity of the stitch size is achieved. The smaller sinking surface 6 provides an optimal stitch pattern for R-R knitting.

Figure 3:
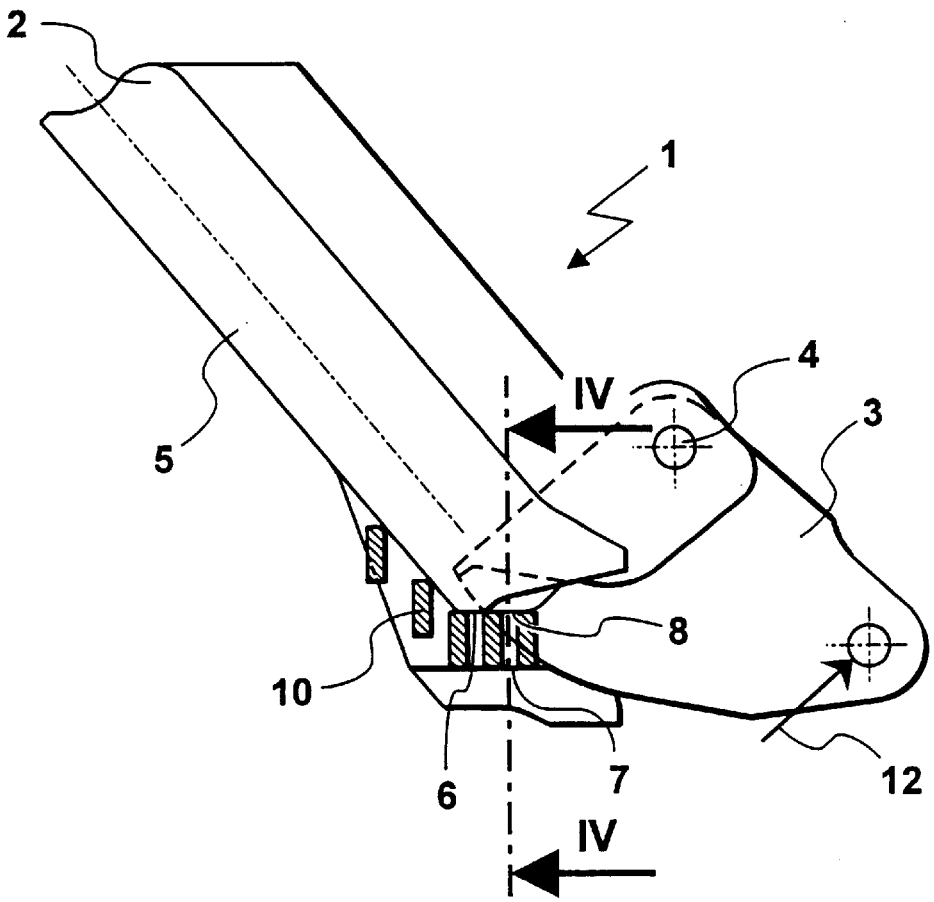
FIG. 3 is a view substantially corresponding to the view of FIG. 2, in a second adjustment position of the sinking element.

FIG. 3 shows the arrangement 1 of FIG. 2, when the sinking element 3 is turned by acting in direction of the arrow 12 to its outer end position. Now the sinking surface 8 closes on the sinking surface 6 of the stitch cam 2 and thereby expands it. Due to the expanded surface 6 and 8, now several needle feet 10 can be simultaneously held in the deepest sinking position. Thereby an optimal stitch pattern for a single-surface smooth knitting is obtained.

Figure 4:
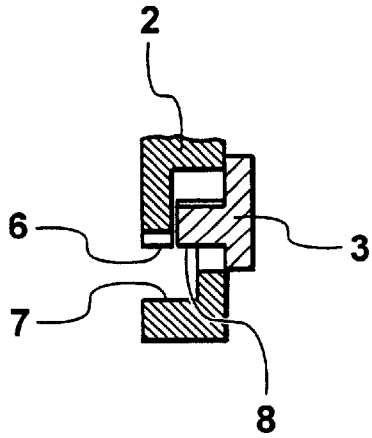
FIG. 4 is a view showing a section taken along the line IV—IV through an arrangement of FIG. 3.

As can be seen in the section shown in FIG. 4, the sinking surfaces 8 of the stitch cam 2 and the sinking surfaces 8 of the sinking element 3 are located in different planes. This makes possible, in cooperation with not shown needle selection device and also not shown knitting cam with pressing cam technique, to achieve that each individual knitting needle can be preset so that it must be sinking over the small sinking surface 6 or over the wide sinking surface 6 plus 8. Needle feet 10 which abut with half foot height against the stitch cam 2 are sinking on the small surface 6, and the needle feet 10 which abut against the whole foot height on the stitch cam are sinking on the surface 6 plus 8. In this manner it is possible in the knittings in which within one knitting row in exchange of a single-surface binding type to a double-surface binding type occurs, to form each stitch in the optimal form.

Figure 5:
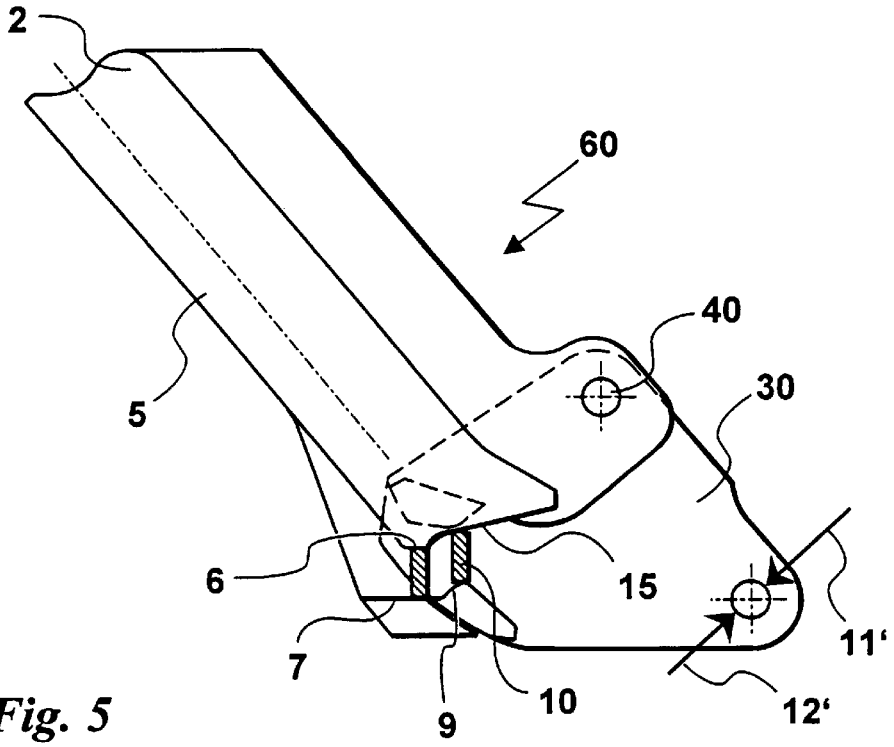
FIG. 5 is a view substantially corresponding to the view of FIG. 2 and showing a stitch cam with a sinking element of a second embodiment.

The arrangement 60 shown in FIG. 5 corresponds to the arrangement 1 of FIGS. 2 and 3, but with the additional possibilities that the needles after reaching the sinking position can perform a definite unloading movement. The arrangement has again a stitch cam 2 and a sinking element 30 which is turnable to its inner end position around the point 40 and assumes the position shown in FIG. 2. The sinking element 30 has however an additional guiding surface 9 which presses the needle feet 10 after sinking against the small sinking surface 6 of the stitch cam 2 again a little upwardly and thereby somewhat drives out the needles, whereby the tension in the knitting threads is reduced. A positive guiding surface 15 is provided on the stitch cam 2 to bring the needles to their immovable position. In cooperation with the not shown needle selecting device and also not shown cam, with pressing cam technique for each individual knitting needle it can be determined whether they must perform the unloading movement or not. The needle feet 10 which about only with half foot height against the stitch cam perform no unloading movement, while the needle feet which abut with the whole foot height against the stitch cam are engaged by the curved surface 9 and thereby perform the unloading movement.

When with this structural shape of the sinking element 30 it is turned to its outer end position (not shown), the selected needles can be sinking either on the small sinking surface 6 or on the wide sinking surface 6 plus 8.

Figure 6:
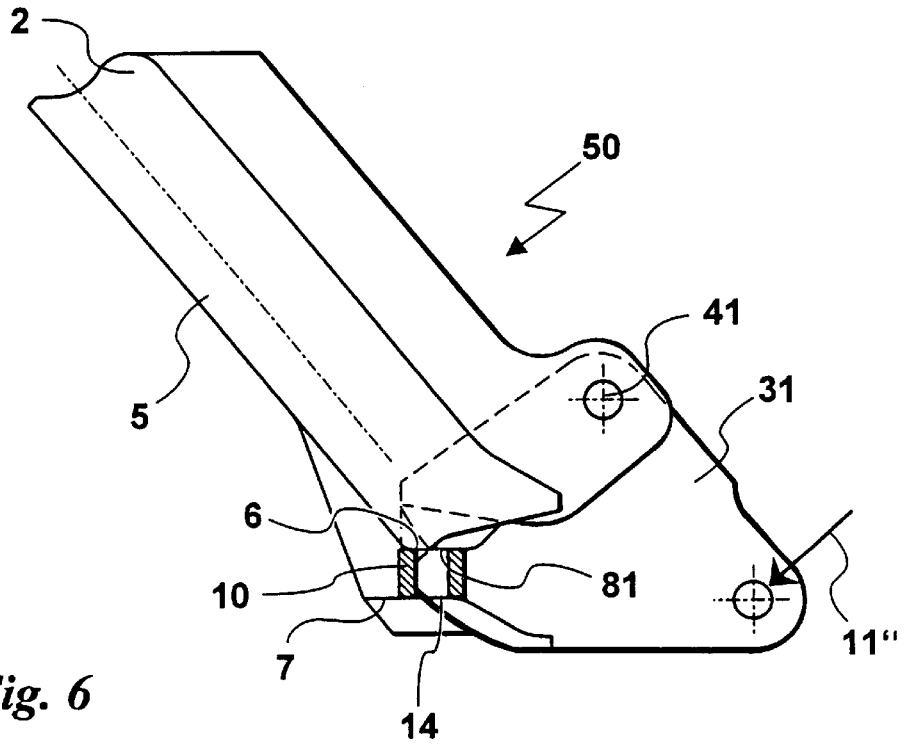
FIG. 6 is a view substantially corresponding to the view of FIG. 2 and showing a stitch cam with a sinking element in accordance with a third embodiment.
Figure 7:
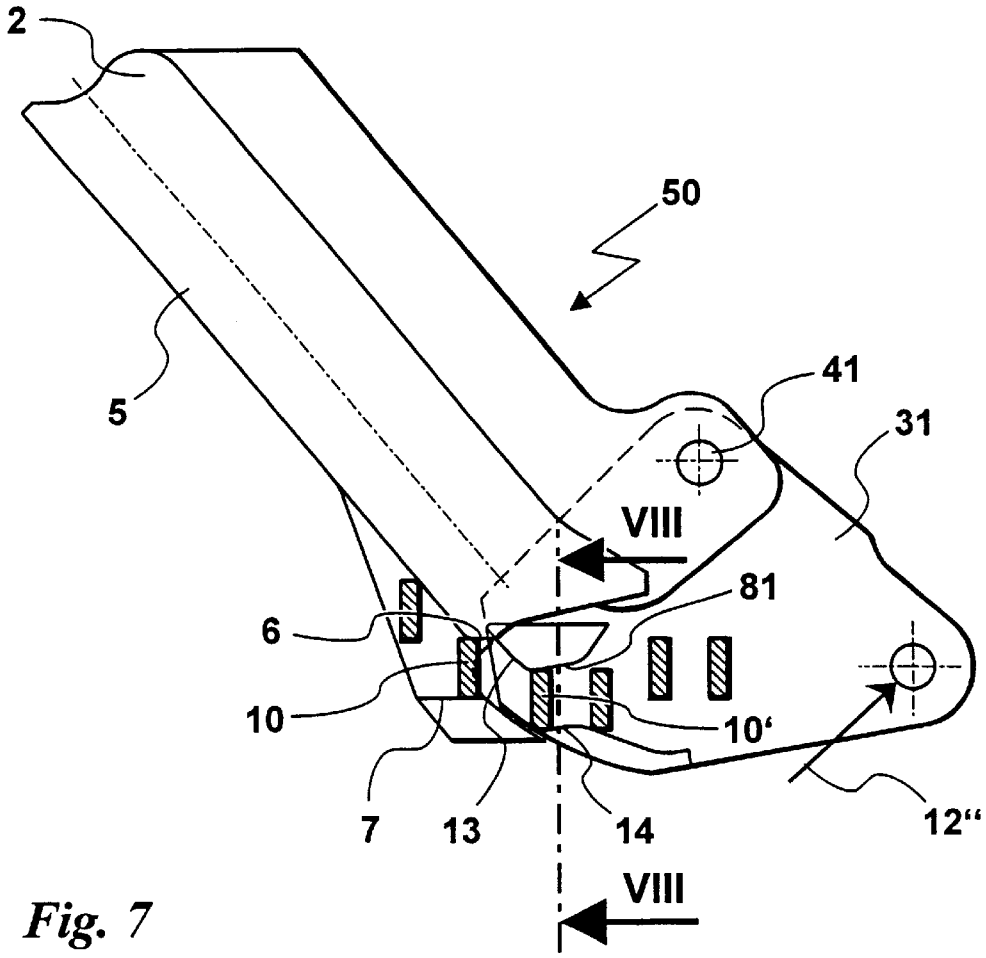
FIG. 7 is a view substantially corresponding to the view of FIG. 2 and showing a stitch cams and a sinking element for stepless influence of the stitch size.
Figure 8:
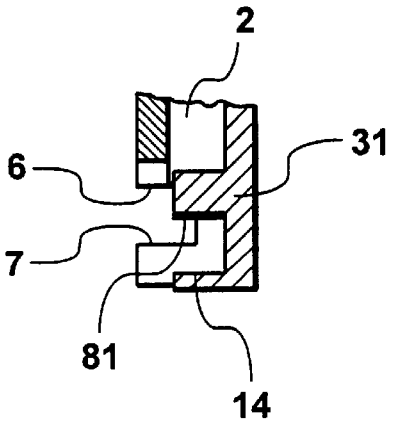
FIG. 8 is a view showing a section taken along the line VIII—VIII through the arrangement of FIG. 7.

The arrangement 50 shown in FIGS. 6 and 7 makes possible the formation of stitches with another stitch size than the stitches formed with the sinking surface 6 of the needle sinkers 2. The arrangement has also a stitch cam 2 with a small sinking surface 6, as well as a positive guiding surface 7. The associated sinking element 31 is again supported turnably about a rotary point 41, and in FIG. 6 is shown in its inner end position by loading in direction of the arrow 11". The needle feet which only with a half foot height against the stitch cam 2 are sinking against the small surface 6. The sinking surfaces 6 and the surface 7 form a positive guide. The feet which abut against the whole foot height against the needle stitch cam 2 are sinking on the wide sinking surface 6 plus 8. The positive guidance is formed by the surfaces 7 as well as a further surface 14 on the sinking element 31.

FIG. 7 shows the sinking element 31 which is turned under the action in direction of the arrow 12" to its outer end position. The feet of the needles which form a stitch side corresponding to the needle sinking position are located with the half foot height against the stitch cam 2 and are sinking over the surface 6. The surfaces 6 and 7 form a positive guide for these needles.

The feet of the needles which must form a greater stitch than that which corresponds to the needle sinking position, abut with the whole foot height against the stitch cam 2. Their path for sinking extends over the planes 5 and 6 formed by the stitch cam 2, to the plane 13 formed on the sinking element 31, and then to the surface 81. This surface 81 is the sinking surface for the greater stitches and forms a positive guide with the guide stitch limiting surface 14 which can be formed on the sinking element 31.

The sinking element 31 can be turned from its inner turning position shown in FIG. 6 to its outer position shown in FIG. 7. This makes possible a stepless increase of the stitches which are formed on the sinking surface 81, when compared with those which are formed on the sinking surface 6. The adjustment of the sinking element 31 can be performed during the knitting process, so that it is possible to produce individual stitches of the stitch row in different sizes.

It will be understood that each of the elements described above, or two or more together, may also find a useful application in other types of constructions differing from the types described above.

While the invention has been illustrated and described as embodied in flat knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A flat knitting machine, comprising at least one needle bed; a carriage which slides along said needle bed, which has at least one cam with needle selection means and stitch cams; a sinking element which cooperates with said stitch cams and is arranged movably on said stitch cams, said sinking element being controllable independently from said stitch cams and together with said stitch cams forms sinking surfaces which depending on its position have a different parameter selected from the group consisting of different form, different size, and both.

2. A flat knitting machine as defined in claim 1, wherein said sinking element is adjustable so as to set a small or a wide sinking surface.

3. A flat knitting machine as defined in claim 1, wherein at least one of said stitch cams and said sinking element are provided with positive guiding surfaces.

4. A flat knitting machine as defined in claim 1, wherein said sinking elements has a guiding surface for a needle foot, which after sinking of a stitch provides a drive of a needle in a definite distance from said sinking surface.

5. A flat knitting machine as defined in claim 1, wherein said sinking element has a guiding surface for a needle foot, with which a pulling depth of certain needles is changeable relative to a pulling depth by said sinking surface.

6. A flat knitting machine as defined in claim 1, wherein said guiding surface is formed so as to provide a stepless adjustment of a pulling depth of said needles.

7. A flat knitting machine as defined in claim 1, wherein said sinking element is arranged turnably on said stitch cam.

8. A flat knitting machine as defined in claim 1, wherein said sinking element is adjustable during a knitting process.

9. A flat knitting machine as defined in claim 1; and further comprising at least one cam formed as a pressing cam.

* * * * *